United States Patent [19]

Friedenthal

[11] 4,052,056

[45] Oct. 4, 1977

[54] REUSABLE KARATE STRIKING BOARD

[76] Inventor: Robert Friedenthal, 43 Liberty Square Road, Boxboro, Mass. 01719

[21] Appl. No.: 717,568

[22] Filed: Aug. 26, 1976

Related U.S. Application Data

[63] Continuation-in-part of Ser. No. 643,604, Dec. 22, 1975.

[51] Int. Cl.[2] ..... A63J 5/00

[52] U.S. Cl. ..... 272/76; 428/58; 428/133

[58] Field of Search ..... 272/76, 77, 8 N, 27 N; 273/105.4, 102 A, 1 AP; 46/16, 17, 24, 26; 428/57, 58, 131, 132, 133, 122, 138, 53, 54, 56, 43, 59

[56] References Cited

U.S. PATENT DOCUMENTS

| | | | |
|---|---|---|---|
| 3,973,772 | 8/1976 | Milliken | 272/76 |
| 4,004,799 | 1/1977 | Kundert | 272/76 |

FOREIGN PATENT DOCUMENTS

| | | | |
|---|---|---|---|
| 688,911 | 6/1964 | Canada | 46/24 |

*Primary Examiner*—Richard C. Pinkham
*Assistant Examiner*—T. Brown
*Attorney, Agent, or Firm*—Morse, Altman, Oates & Bello

[57] ABSTRACT

A karate practice board, for subjection to hand and foot strikes, comprises permanent and disposable parts, by which the practice board inexpensively simulates frangibility and permits reassembly. The permanent parts of the board being similar in configuration and each being provided with a concavity in an edge portion thereof. The disposable parts being smaller than the permanent parts and being configured to removably slide into the concavities whereby the permanent parts can be temporarily joined at their edges such that they will appear as a single board. Upon striking the board with a predetermined force, the insert part will be severed to separate the permanent parts. The severed insert part will be removed from the concavity of each permanent part and another insert part will be inserted to render the board reusable. Each insert part having a different strength which will require a different predetermined severing force.

4 Claims, 4 Drawing Figures

REUSABLE KARATE STRIKING BOARD

RELATED APPLICATION

The present application is a continuation-in-part of application Ser. No. 643,604, filed Dec. 22, 1975.

BACKGROUND OF THE INVENTION

1. Field of the Invention

The present invention relates to practice equipment for the martial arts and, more particularly, to a novel karate practice board for hand and foot strikes.

2. The Prior Art

Karate practitioners frequently break wooden boards or like members in order to develop and demonstrate powerful hand and foot strikes. One board or a stack of boards is supported at its opposite edges, generally with its grain running parallel to these edges, and is struck medially by the foot or the hand. If the strike is sufficiently powerful and properly executed, the board or boards will break in two. In the past, boards thus broken have been discarded. Since a typical karate practitioner thus may destroy many boards each day, as many as 10, 2.5 centimeter thick boards at a single blow, karate practice can be unduly expensive. Also wooden boards tend to vary unpredictably in their resistance to severing force so that, in the past, the karate practitioner has had no calibrated gauge of the force he is capable of delivering.

SUMMARY OF THE INVENTION

The primary object of the present invention is to provide a karate practice board, for subjection to hand and foot strikes, comprising at least three specific parts, including two outer permanent parts and at least one disposable insert part. By means of the insert part, the outer parts can be severed and mated. The two outer parts have at least a pair of matched edges with matched concavities for the reception of the opposite ends of the insert part. When this insert part is received by the matched concavities and the matched edges of the outer parts are registered, the board appears to be an integrated unit with a joint between the two outer parts. When a hand or foot strike of sufficient force and proper position is imparted in the vicinity of the joint, the insert part fractures and the two outer parts sever. The insert part is relatively small and inexpensive and the outer parts are relatively large and expensive so that repeated use can be made of the board at low cost.

Another object of the present invention is to provide a kit comprising a pair of permanent parts of the foregoing type and a plurality of inserts which are calibrated to enable severing upon the application of different forces. This kit permits the karate practitioner to guage the precise force of his strikes and to develop his skill and force methodically.

Other objects of the present invention will in part be obvious and will in part appear hereinafter.

The invention accordingly comprises the product, together with its parts and their relationships, which are exemplified in the accompanying disclosure, the scope of which will be indicated in the appended claims.

BRIEF DESCRIPTION OF THE DRAWINGS

For a fuller understanding of the nature and objects of the present invention, reference is made to the following detailed descriptions, taken in connection with the accompanying drawings, wherein.

DETAILED DESCRIPTION TO THE PREFERRED EMBODIMENTS

Figure 1:
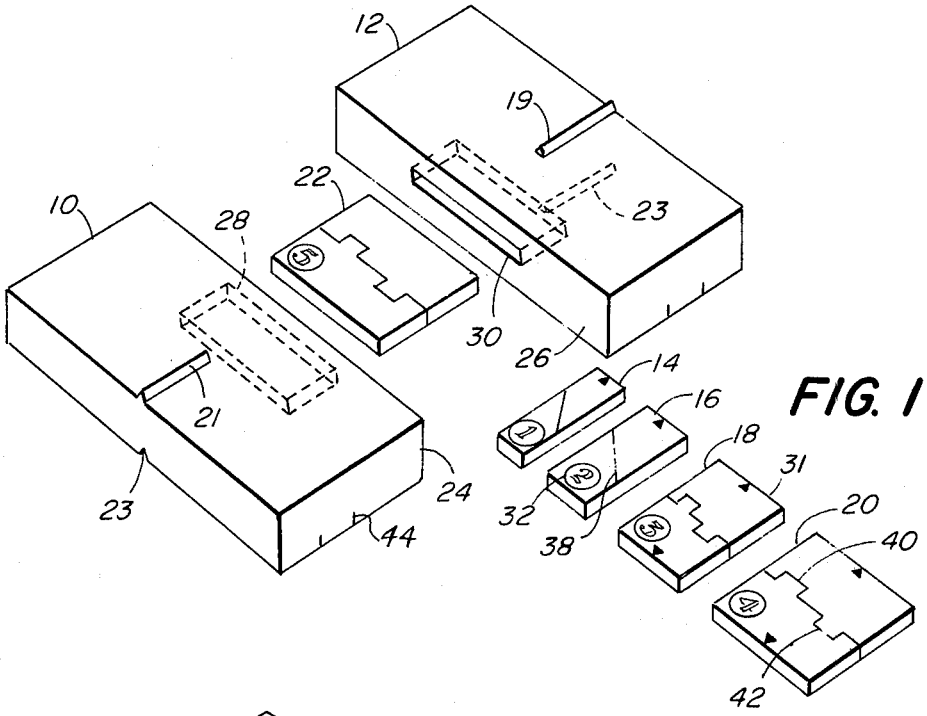
FIG. 1 is a perspective view of the various parts of a kit embodying the present invention.

Generally, the kit of FIG. 1 comprises a pair of permanent outer parts 10, 12 and a set of insert parts 14, 16, 18, 20, 22. Outer parts 10, 12 have matched edges 24, 26 that have matched concavities 28, 30. Each matched edge is a mirror image of the other. Each concavity is a mirror image of the other. When the matched edges are registered, the concavities are registered. As shown, each of concavities is a parallepiped-shaped slot that extends into its part along a plane that is perpendicular to the matched edge in which it is formed.

Inset parts 14, 16, 18, 20, 22, which are parallelpiped shaped, are of the same length and thickness but of different widths. This length is approximately equal to the combined lengths of slots 28, 30 along the axis of the assembled board so that, when the outer and inner parts are assembled, matched edges 24, 26 are in contiguity. Their thickness is slightly less than that of slots 28, 30 so that their opposite ends can be inserted easily into the slots. Their widths are graduated so that they provide graduated shear strength. In other words, the counterforces they exert in response to bending moments produced by karate strikes vary with their width.

As shown, each insert part has at least one visual indicium, in the present case an arrow 31, which clearly indicates which edges of the inserts are to be fitted into slots 26, 28. Also, each insert part has a visual indicium, in the present case a number 32, which indicates the strength of the board when assembled with that insert part. Also, each insert part has a transverse score, i.e., a slight groove along at least one of its surfaces, which tends to cause a break, when it occurs, to follow a predetermined line. This line is such that, when the assembled board is severed, projections 34, 36 of the insert part will extend outwardly from slots 28, 30 in order to facilitate removal of the two portions of the insert part from the slots. As shown, each of insert parts 14, 16 is scored along a diagnal line 38 which crosses from one half of the insert part to the other. And each of insert parts 18, 20, 22 is scored along a centerline that defines a tab 40 projecting into one half and a tab 42 projecting into the other half of the insert part.

Figure 4:
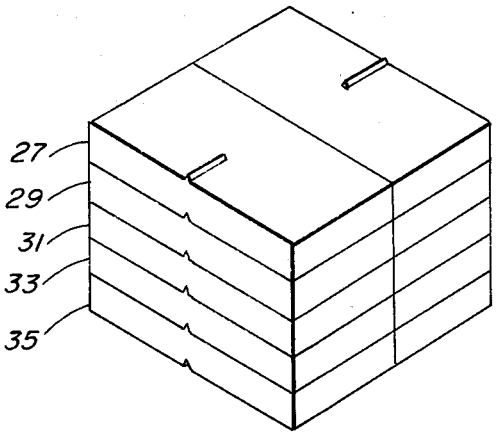
FIG. 4 is a perspective view of an assembly of karate practice boards of the type shown in FIG. 1.
Figure 2:
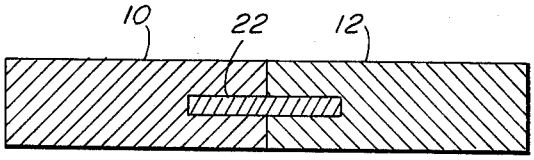
FIG. 2 is a cross-sectional view of an assembled karate practice board embodying the present invention.
Figure 3:
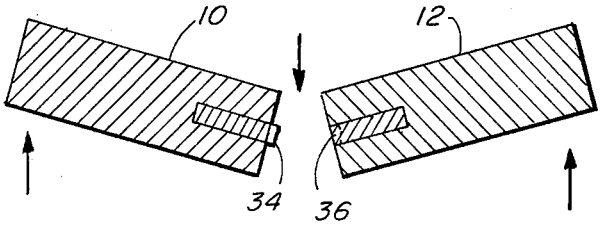
FIG. 3 is a cross-sectional view of a severed karate practice board embodying the present invention.

Parts 10, 12 have ribs 19, 21 at their upper faces extending in alignment from a point spaced from the junction to the opposite extremities of the board and notches 23, 25 at their lower faces extending in alignment from a point spaced from the junction to the opposite extremities of the board. These ribs and notches facilitate the alignment of a plurality of boards of the type shown in FIG. 1. As shown in FIG. 4, an assembled group of such boards shown at 27,29,31, 33,35 with their ribs and notches meshed, enables multiple board strikes when desired. Indicia 44, which extend along an edge perpendicular to the junction, indicate support positions by which differing striking forces can be established with this single striking board.

In a preferred form, the construction and composition are as follows. Permanent outer parts 10, 12 are composed of either wood (with its grain extending perpendicularly with respect to the matched edges) or of a resilient polymer, particularly a resilient polymer such as hard rubber (for example neoprene or polyisobutylene) or a solid foam, particularly a microcellular foam (for example closed cell polyethylene foam). Preferably each of parts 10, 12 ranges: in length from 5 to 20 centimeters (2 to 8 inches); in width from 5 to 20 centimeters (2 to 8 inches); and in thickness from 0.5 to 5.0 centimeters (0.2 to 2.0 inches). Disposable insert parts 22 are composed of either wood (with its grain extending perpendicularly with respect to the edges to be inserted into slots 28,30) or of a hard polymer such as polystyrene or polymethyl methacrylate. The insert parts range: in width (along the junction) from 2.5 to 12.5 centimeters (1 to 5 inches); in length (perpendicular to the junction) from 2.5 to 20 centimeters (1 to 8 inches); and in thickness from 0.2 to 1.0 centimeter (0.2 to 2.0 inches).

OPERATION

In operation, a karate practitioner can strike the practice board of the kit of FIG. 1 sequentially with different insert parts in order to gauge his comfortable striking force and then can practice with a selected insert part repetitively by alternately mating and striking.

Since certain changes may be made in the foregoing disclosure without departing from the scope of the invention herein, it is intended that all matter shown in the foregoing disclosure or in the accompanying drawings be interpreted in an illustrative and not in a limiting sense.

What is claimed is:

1. A striking board kit comprising first and second substantially rigid parts, said first part and said second part having matched edges and matched concavities in said matched edges, and a plurality of severable insert parts, each insert part having a portion thereof removably insertable in said concavities of said first and second parts to render said matched edges contiguous and temporarily joined along an elongated junction, the strength of each insert part being sufficiently great to require a strike of a predetermined force at said junction to rupture said insert part the construction of each insert part and the removable connection between said insert part and concavities being such that said strike of a predetermined force will necessarily rupture said insert part, said ruptured insert part being removed from said concavities for insertion of another of said plurality of insert parts into said concavities thereby rematching said edges of said first and second parts to once again permit rupture by a predetermined force.

2. The striking board kit of claim 1 wherein said insert part is scored along a line that is disposed substantially along said junction.

3. The striking board kit of claim 1 wherein the shear strength of said insert part is less than the shear strength of said first part and said second part.

4. The striking board kit of claim 1 wherein certain of said insert parts have greater shear strength than others of said insert parts.

* * * * *